United States Patent [19]

Pavlisko et al.

[11] Patent Number: 4,847,175

[45] Date of Patent: Jul. 11, 1989

[54] ELECTROPHOTOGRAPHIC ELEMENT HAVING LOW SURFACE ADHESION

[75] Inventors: Joseph A. Pavlisko, Pittsford; Hsin-Chia Kan, Fairport, both of N.Y.

[73] Assignee: Eastman Kodak Company, Rochester, N.Y.

[21] Appl. No.: 127,848

[22] Filed: Dec. 2, 1987

[51] Int. Cl.[4] ..... G03G 5/05; G03G 5/14

[52] U.S. Cl. ..... 430/58; 430/96

[58] Field of Search ..... 430/96, 58

[56] References Cited

U.S. PATENT DOCUMENTS

| | | | |
|---|---|---|---|
| 3,501,294 | 5/1970 | Joseph | 430/101 |
| 3,967,692 | 1/1976 | O'Malley | 430/124 X |
| 4,111,693 | 9/1978 | Wright et al. | 430/73 X |
| 4,175,960 | 11/1979 | Berwick et al. | 430/64 X |
| 4,284,699 | 8/1981 | Berwick et al. | 430/96 |
| 4,444,861 | 4/1984 | Nogami et al. | 430/58 |
| 4,578,334 | 3/1986 | Borsenberger et al. | 430/78 X |
| 4,618,553 | 10/1986 | Yuyama et al. | 430/69 |
| 4,637,971 | 1/1987 | Takei et al. | 430/96 X |

FOREIGN PATENT DOCUMENTS 1478417 6/1977 United Kingdom .

OTHER PUBLICATIONS

Derwent Abstract 86-145729/23.
Derwent Abstract 86-032555/05.
Derwent Abstract 86-032552/05.
Derwent Abstract 86-032553/95.
Derwent Abstract 85-319876/51.
Derwent Abstract 85-034748/06.

*Primary Examiner*—Paul R. Michl
*Assistant Examiner*—Jeffery A. Lindeman
*Attorney, Agent, or Firm*—Bernard D. Wiese

[57] ABSTRACT

A reusable electrophotographic imaging element having a photoconductive surface layer of which the binder resin comprises a crystalline side chain polyester or a block copolyester or copolycarbonate having a crystalline side chain polyester block. The layer has low surface adhesion which improves the transfer of toner images to receiver sheets, improves the cleaning efficiency and prevents or reduces toner scumming on the surface layer.

14 Claims, 1 Drawing Sheet

ELECTROPHOTOGRAPHIC ELEMENT HAVING LOW SURFACE ADHESION

FIELD OF THE INVENTION

This invention relates to electrophotography and more particularly to an electrophotographic imaging element having improved image transfer properties and other valuable properties.

BACKGROUND OF THE INVENTION

In electrophotographic imaging processes, such as in electrophotographic copying machines an electrostatic latent-image charge pattern is formed on the photoconductive element which includes a photoconductive layer deposited on a conductive support and can be in the form of a belt, drum or plate. By treating the charge pattern with a dry developer containing charged toner particles, the latent image is developed. The toner pattern is then transferred to a receiver such as a sheet of paper to which it is fixed by fusion or other means.

In the most effective modern photocopiers, the active layers of the photoconductive element comprises organic charge generation or charge transport materials dispersed in a binder resin matrix. To permit long, continuous use of these photoconductive elements, the binder resin must be tough and strong. A problem, however, in transferring the developed image to a receiver is that the attraction of the toner to the surface layer of electrophotographic elements which employ the usual kinds of tough organic binder resins can cause incomplete transfer of toner. The resulting transferred image on the receiver has hollow characters and other defects. The problem is especially severe when the image is transferred by pressing a receiver element such as a paper sheet into contact with the tone surface of the photoconductive element.

Efforts to solve the image transfer problem have included providing abhesive or release coatings to the surface layers of photoconductive elements. A drawback of this attempt to solve the problem is that an insulating, non-photoconductive overcoat can interfere with the photoconductive properties of the element. If the coating is thick, it can reduce the electrophotographic speed or sensitivity. Even if thin, an insulating overcoat layer can shorten the life of a photoconductive film to such an extent that it cannot be regenerated for repeated use. This is believed to be caused by the trapping of residual charges between the insulating coating and the active surface layer. If the surface layer is merely coated with a soft release substance such as a metal stearate, the coating rapidly wears off and the transfer problem reappears. There is a need, therefore, for a binder composition for the surface layer of photoconductive elements which provides suitable surface properties for good image transfer without the necessity for release overcoats and yet which also has the physical strength required of binders in reusable photoconductive elements.

In addition to the need for a binder composition having good toner image transfer properties and good physical strength, there is also a need for such a composition that is soluble in volatile coating solvents and that is compatible with phthalocyanine photoconductive pigments. The latter are of particular importance in photoconductive elements having sensitivity to infrared radiation and, hence, utility in recording the output of light emitting diodes and lasers. Pigments of this class do not disperse uniformly in many otherwise suitable binder resins. Accordingly, a binder resin matrix composition having the combination of physical strength, good image transfer capability and compatibility with photoconductive pigments has been needed.

SUMMARY OF THE INVENTION

In accordance with the present invention, a reusable electrophotographic element is provided which in its surface layer contains a binder resin matrix having the desired combination of properties. As a consequence, the element is strong enough for repeated use and, even after many cycles of use, its image transfer properties are excellent. The surface layer composition is solvent coatable and is compatible with photoconductive pigments such as phthalocyanines. It is especially suitable for use with toners of small particle size to form images of high resolution.

The reusable electrophotographic imaging element of the invention has an active surface layer of organic charge generation or charge transport materials dispersed in an electrically insulating polymeric binder matrix which comprises a polymer containing polyester repeating units which have crystalline side chains.

Preferably the polymer is a block copolyester or a copolycarbonate containing crystalline side chain polyester block. Also in a preferred embodiment, the surface layer contains as a charge generation material a photoconductive pigment, most preferably, a phthalocyanine pigment.

THE DRAWING

The sole FIGURE of the drawing is an enlarged diagrammatic sectional view of a photoconductive element of the invention.

DETAILED DESCRIPTION

Figure 1:
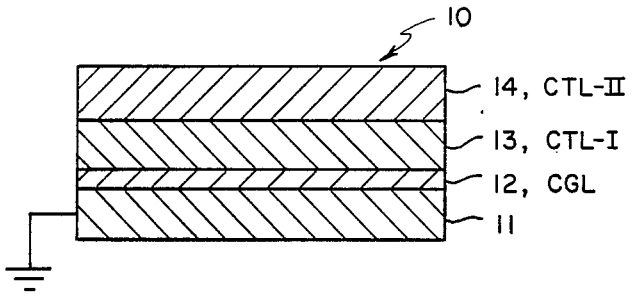

To describe the invention in more detail, reference will be made to the drawing which illustrates in cross section one type of electrophotographic imaging element of the invention, namely, a multilayer photoconductive element. This kind of element, also called a multiactive photoconductive element, has separate charge generation and charge transport layers. The configuration and principles of operation of multiactive photoconductive elements are known, having been described in a number of patents, for example, in the patents to Berwick et al, U.S. Pat. No. 4,175,960; Wright et al, U.S. Pat. No. 4,111,693; and Borsenberger et al, U.S. Pat. No. 4,578,334. The photoconductive elements of the invention can be prepared substantially as described in these patents, but using a binder resin matrix in the surface layer which contains a polymer having crystalline side chain polyester repeating units. By "crystalline side chain polyester repeating units" is meant that the polyester repeating units have side chains, such as $C_{18}$ alkyl and the like, which are crystalline.

Also within the scope of the invention are elements in which a single photoconductive layer containing such a binder resin matrix is disposed on an electrically conductive support. Another suitable configuration is the inverted multilayer form in which a charge transport layer is coated on the conductive substrate and a charge generation layer is the surface layer. Examples of inverted multilayer elements are disclosed in the patent to Berwick et al, U.S. Pat. No. 4,175,960. In whichever configuration is selected, the polymer having crystalline side chain polyester repeating units is in the surface layer of the photoconductive element.

In the drawing, the photoconductive element 10 has a conductive support 11, a thin charge generation layer 12, another relatively thick first charge-transport layer 13 and a relatively thick second charge-transport layer 14 which is the surface layer of the element. The conductive support 11 can be of conventional structure comprising, for example, a nickel-coated poly(ethylene terephthalate) film. The charge generation and charge transport layers comprise charge generation or charge transport materials dispersed in an electrically insulating binder resin matrix. Most significantly, with respect to the present invention, the binder resin matrix for the surface layer 14 comprises a polymer of the type referred to above, i.e., a polymer containing a polyester repeating unit having crystalline side chains. Advantageously, this polymer is a block copolyester or copolycarbonate having a polyester block with crystalline side chains. Also, advantageously, the block copolymer is the sole binder resin of the surface layer. Alternatively, however, the block copolymer can be blended as an additive with other polyester or polycarbonate binder resins. Also, alternatively, a crystalline side chain polyester of the kind used to prepare the block polyester can be used as an additive with such other polyester or polycarbonate binder resins. In any event, the amount of such block copolymer or polyester in the binder resin matrix, is sufficient to provide from about 5 to 50 weight percent of crystalline side chain polyester repeating units in the binder resin matrix.

The binder resin matrix containing the described block copolymer or containing the polyester as an additive has improved surface properties, in particular, an improved toner image transfer capability. Furthermore, it has the strength and toughness required in reusable photoconductive films and is compatible with phthalocyanine photoconductive pigments.

The polyesters which are used as an additive for the binder resin matrix or as an oligomeric precursor for the block copolyester or copolycarbonate have repeating units of the general formula

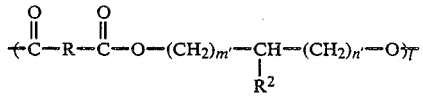

wherein

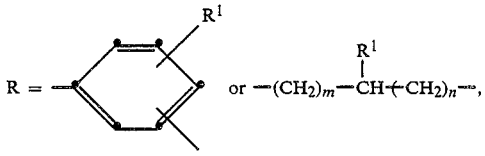

wherein m, n, m' and n' are zero or positive integers, m+n=0 to 3, m'+n'=1 to 5, $R^1$ and $R^2$ are crystalline aliphatic hydrocarbon side chain groups or hydrogen, with the proviso that no more than one of such groups is hydrogen, and l is an integer from 1 to 10. These repeating units have appropriate endcapping groups. When used as precursors for block copolymer, the endcapping groups are functional groups for condensation reactions, such as —OH, —COOH, or —COHal (Hal being halogen, preferably Cl or Br).

The block copolyesters or copolycarbonates can be made by copolymerizing binder resin polyester or polycarbonate monomers with a crystalline side chain polyester which is endcapped with functional groups for condensation reactions and the repeating units of which have crystalline side chains.

The crystalline aliphatic hydrocarbon groups $R^1$ and $R^2$ can be either straight or branched chain, alkyl or olefinic groups, so long as the substituent is crystalline. Preferred are alkyl groups of from 12 to 20 carbon atoms, e.g., n-dodecyl, n-hexadecyl, n-octadecyl and 2-ethyloctadecyl. Especially preferred are long straight chain alkyl groups of up to 20 carbon atoms. Although, the molecular weight of the polyester can vary over a considerable range, the preferred polyesters as precursors for the block copolymers are of molecular weight, e.g., Mn=2000 to 12,000. If used as additives (i.e., not as repeating units of a block copolymer), they are preferably of molecular weight, e.g., Mn=4,000 to 15,000.

An important advantage of the binder resin compositions of the present invention is that they are soluble in commonly used volatile coating solvents such as dichloromethane and tetrahydrofuran. Dichloromethane is a preferred coating solvent because of its low boiling point, high vapor pressure and non-flammability. The components of the photoconductive layers, e.g., binder resins, pigments, charge transport materials, charge generation materials and the crystalline side chain polyester, if used as an additive, are dissolved or dispersed in the coating solvent, then coated on the appropriate substrate and the volatile solvent is evaporated. The polyesters or block copolymers containing the crystalline (or crystallizable) side chains dissolve in coating solvents such as dichloromethane, as do the usual amorphous binder resin components, and when the solvent is evaporated the hydrocarbon side chains form crystalline domains in the amorphous matrix or continuous phase of the surface layer of the photoconductive element.

Regarding the solubility of the crystalline side chain polyester in coating solvents, the chain length and, hence, the melting point (Tm) of the crystalline or crystallizable repeating units is significant. The Tm of these crystalline blocks can be as low as just above room temperature, e.g., as low as about 30° C. When the side chains are octadecyl groups the Tm is around 61° C. and this is satisfactory. However, if the side chains are too long, the polyester and block copolymer will not be soluble in the more desirable volatile solvents. For instance, an ethylene glycol/substituted succinic anhydride polyester having $C_{30}$ alkyl side chains had a Tm of 70° C. and the crystalline polyester repeating units were not soluble in dichloromethane. The polyester, therefore, could not be satisfactorily coated with that particular solvent.

As already mentioned, the copolymers and polyesters having crystalline side chains are compatible with phthalocyanine photoconductive pigments. By this is meant that when dispersed in binder resin matrix comprising such crystalline side chain polymers, the phthalocyanine pigments do not agglomerate as they do in some binder resins which are otherwise satisfactory because of good toner release properties. As a result, finely divided phthalocyanine pigment particles such as disclosed in the patent to Hung, et al, U.S. Pat. No. 4,701,396, can be used to full advantage with toners of small particle size to form images of very high resolution.

The crystalline side chain polyesters, whether to be used as an additive in the binder resin matrix or as a precursor for a block copolyester or copolycarbonate, can be made by known polyesterification methods, including either bulk or solution polymerization. The selected diol and dicarboxylic acid (or its polyesterification equivalent) are reacted in approximately equimolar proportions. The crystalline side chain such as a long alkyl side chain is present either in the diol or the diacid or in both. Examples of useful reactants for synthesizing the polyester include, as diacids, 2-n-octadecylsuccinic acid, phthalic acid, isophthalic acid, terephthallic acid and 2-octadecylterephthalic acid, and as diols, ethylene glycol, 1,3-propane diol, 1,4-butane diol, neopentyl glycol, 2-dodecyl-1,3-propane diol, 2-octadecyl-1,4-butanediol and 1,10-decanediol.

Following are examples of crystalline side chain polyester repeating units, which can, with appropriate endcapping, be polyester additives or can be repeating units of block copolyesters or copolycarbonates:

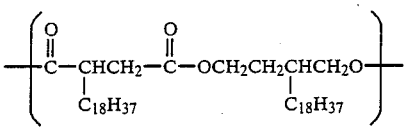

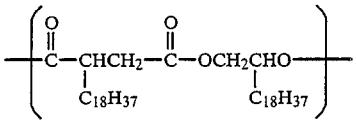

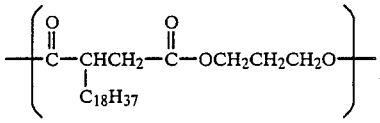

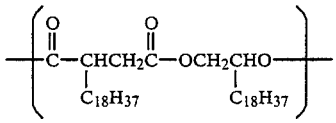

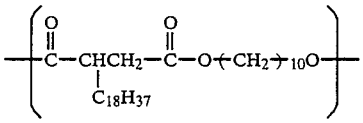

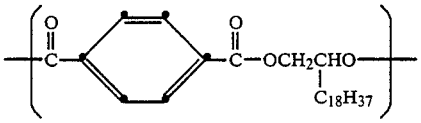

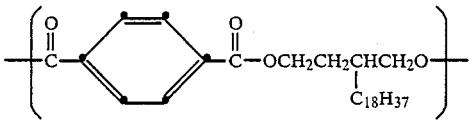

-continued

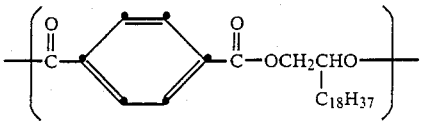

The block copolymer contains a block or blocks derived from the crystalline side chain polyester and the polyester or polycarbonate binder resin segments derived from the monomeric diacids and diols. The latter can be selected from a range of amorphous polymer types that are suitable as binder resins (e.g., have the requisite physical strength and electrical insulating properties) for photoconductive elements surface layers. Suitable types include poly(bisphenol-A carbonate), poly(tetramethylcyclobutylene carbonate) and poly(arylene-) or poly(alkylene phthalates) such as poly(ethylene terephthalate), poly(tetramethylene terephthalate), poly(tetramethylene isophthalate), poly(tetramethyleneglyceryl terephthalate), poly(hexamethylene terephthalate), poly(1,4-dimethylolcyclohexane terephthalate), poly(p-benzenediethyl terephthalate), poly(bisphenol-A terephthalate), poly(4,4'-(2-norbornylidene)bisdiphenol terephthalate), poly(4,4'-(hexahydro-4,7-methanoindan-5-ylidene)diphenol terephthalate) or isophthalate, poly(tetramethylene-2,6-naphthalene dicarboxylate), poly(xylylene-2,6-naphthalene dicarboxylate), poly(ethylene adipate), and poly[ethylene bis(4-carboxyphenoxyethane)].

Preferably, the binder resin segment of the copolymer is a complex polyester formed from one or more diacids (by which term we mean to include the esterification equivalents such as acid halides and esters), and one or more diols, e.g., from dimethyl terephthalate, 2,2-norbornanediylbis-4-phenoxyethanol and 1,2-ethanediol or from a terephthaloyl halide, an azelaoyl halide and 4,4'-(2-norbornylidene)bisphenol. Other useful binder resin polyesters include those disclosed, e.g., in the patent to Berwick et al, U.S. Pat. No. 4,284,699.

In preparing the block copolymer, the polymerization reaction of the oligomer and the polyester or polycarbonate monomers can be carried out by known techniques such as bulk polymerization or solution polymerization. To achieve optimum results, a crystalline side chain polyester oligomer having a molecular weight (Mn) from about 500 to 15,000 and, preferably, 2,000 to 12,000, should be used as a precursor for the block copolymer. The amount of oligomer employed in the reaction should be sufficient to provide the desired surface properties but not so much as to reduce the physical strength of the ultimate binder matrix excessively. The exact amount will depend on the desired balance of these properties and also on whether the block copolymer is the sole binder in the binder matrix or is blended as an additive with another binder resin. Preferably, however, the amount of the polyester oligomer employed should be sufficient to provide from about 5 to 50 weight percent of the resulting block copolymer and most preferably from about 10 to 30 weight percent.

If the polyester is to be used as such as an additive for the binder resin matrix it can be synthesized in the same way and with the same reactants as are used for making the polyester oligomer precursor for the block copolymer. However, when used as an additive, the polyester preferably is of higher molecular weight than the oligomer, e.g., having a number average molecular weight up to about 25,000 and preferably from 4,000 to 15,000.

In the block copolymers used in accordance with the present invention, the polyester or polycarbonate segments form an amorphous continuous phase which gives the needed physical strength, and the blocks having crystalline side chains form a discontinuous phase and provide the desired surface properties. These results can be obtained when using the block copolymer as the sole binder resin in the surface layer or when using it or the crystalline side chain polyester oligomer as an additive with one or more other binder resins.

When used for electrophotographic imaging, the surface layer 14 of element 10 is charged in the dark to a suitable voltage, e.g., a negative voltage of 600 volts. The charged element is exposed imagewise to a pattern of actinic radiation such as visible light, causing charges in the exposed areas of the surface layer to dissipate. The surface is then contacted with finely divided particles of a charged dry toner such as pigmented thermoplastic resin particles to develop the electrostatic-charge latent image.

When employed as a reusable imaging element, the toner image is transferred to a paper sheet or other receiver sheet where it is fixed by heat, pressure or other means. The transfer can be accomplished by pressing the receiver sheet into contact with the toned surface of the photoconductive element, e.g., by passage through the nip of pressure rollers, which are suitably electrically biased to attract the charged toner particles from the photoconductive layer to the paper.

In addition to the principal layers which have been discussed, i.e., the conductive substrate and the charge generation and charge transport layers, the photoconductive elements of the invention can also contain other layers of known utility, such as subbing layers to improve adhesion of contiguous layers and barrier layers to control unwanted charge transport. The surface layer can even have a thin release coating such as a thin coating of silicone oil or of fluorocarbon polymer or the like if it is desired to augment the release qualities provided by the crystalline side chain polyester units within the surface layer. Any such coating however, should be sufficiently thin that, as an insulating, nonphotoconductive substance, it does not substantially reduce the electrophotographic sensitivity of the element.

The invention is further illustrated by the following examples which describe the preparation of block copolymers and of photoconductive films containing such copolymers. The first example describes the synthesis of a polyester oligomer which is useful either as an additive for the binder resin matrix or as a precursor for block copolyesters or block copolycarbonates to be used as binder resins or as additives for binder resins.

EXAMPLE 1

Poly(Ethylene 2-n-Octadecylsuccinate)

$$\left(O_2CCH(C_{18}H_{37})CH_2CO_2CH_2CH_2\right)_n$$

| Compound | Amount | Mols | Mw |
|---|---|---|---|
| 2-n-Octadecylsuccinic Anhydride | 70.4 g | 0.20 | 35 |
| Ethylene Glycol | 20 g | 0.32 | 62 |

To a 100 ml polymerization flask was charged 70.4 g (0.20 mole) 2-n-octadecylsuccinic anhydride, 20 g (0.32 mole) ethylene glycol and 2 drops of tetraisopropyl titanate. The contents of the flask were heated under nitrogen to 220° C. and a reflux head attached. The solution was heated at 220° C. for two hours followed by one hour at 240° C. after removal of the reflux head. The flask was then attached to vacuum, 500$\mu$, and contents polymerized at 240° C. for eight hours.

Yield: 76 g., Inherent Viscosity 0.30 dL/g (Dichloromethane 25° C., 0.25% Solids), $T_M$=59° C. Hydroxyl group titration, 0.187 meq/g; Mn=10,700 amu.

The next example describes the use of a polyester oligomer as produced in Example 1 to synthesize a block copolyester which is useful as a binder resin or as an additive in the binder resin matrix.

EXAMPLE 2

Poly(4,4'-(2-norbornylidene)bisphenol terephthalate-co-azelate)-block-poly-(ethylene 2-n-octadecylsuccinate)

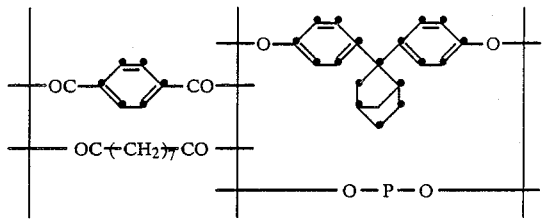

Mw=10,700 amu.
0.185 meq/gr. hydroxyl groups (OH)
0.002 meq/gr. carboxylic acid groups ($CO_2H$)

| Compound | Amount | Mols | Mw |
|---|---|---|---|
| terephthaloyl chloride | 40.6 g | 0.20 | 203 |
| azelaoyl chloride | 67.5 g | 0.30 | 225 |
| 4,4-(2-norbornylidene)-bisphenol | 140.5 g | 0.50 | 280 |
| triethylamine | 110 g | 1.09 | 101 |
| poly(ethylene 2-n-octadecylsuccinate) $\alpha,\omega$-hydroxyl terminated | 90.5 g | 0.0085 | 10,700 |

To a five liter 3-necked round-bottom flask equipped with a mechanical stirrer, addition funnel and argon unit was charged 140.5 g (0.50 moles) 4'4-(2-norbornylidene)bisphenol, 90.5 g of $\alpha,\omega$-hydroxyl terminated poly(ethylene 2-n-octadecylsuccinate), one liter of dichloromethane and 110 g (1.09 mole) triethylamine. The mixed solution was cooled to 25° C. and a solution of 40.6 g (0.20 mole) terephthaloyl chloride and 67.5 g (0.30 mole) azelaoyl chloride in 500 ml of dry dichloromethane added dropwise over a period of two hours. Subsequently, a solution of 4.1 g (0.02 mole) terephthaloyl chloride and 6.75 g (0.03 mole) azelaoyl chloride in 250 ml of dichloromethane was added dropwise over a period of several hours. The addition was terminated when no further increase in the reaction mixture viscosity could be noted. The reaction mixture was diluted with 2 liters of dichloromethane, washed with 109 g sulfuric acid in 4 liters of water, followed with distilled water washings until the polymer dope washings were neutral. The block copolymer was isolated by precipitation into methanol ($\frac{1}{3}$ vol/vol; polymer dope/methanol) and dried in vacuo at 50° C. for 16 hours.

Yield: 207 g; Inherent Viscosity 0.52 dL/g (DCM 25° C., 0.25% Solids); Found C 76.5%, H, 7.9%, N<0.3%.

The next example describes the synthesis of another polyester oligomer which is useful as a [binder resin additive or as a] precursor for a block copolymer.

EXAMPLE 3

Poly(Ethylene 2-n-Octadecylsuccinate)

$$\left(O_2CCH(C_{18}H_{37})CH_2CO_2CH_2CH_2\right)_n$$

| Compound | Amount | Mols | Mn |
|---|---|---|---|
| n-Octadecylsuccinate Anhydride | 17.6 g | 0.05 | 352 |
| Ethylene Glycol | 25 g | 0.4 | 62 |

The procedure was as in Example 1 with the following exceptions:

Initial Reaction Temperature/Times: 220° C./1.5 hrs., 230° C./3.5 hrs.

Polymerization: 230° C./1.5 hrs./500μ.

Yield: 18 g, Inherent Viscosity, 0.18 dL/g (Dichloromethane, 25° C., 0.25% Solids), $T_M$=57° C.; Hydroxyl group titration, 0.47 meq/g; Mn=4,255 amu.(atomic mass units).

The next example describes the preparation and testing of photoconductive films of the invention and of a control.

EXAMPLE 4

Four multilayer photoconductive films, designated as Films A, B, C, and D, were prepared. For each the support or base was a nickelized poly(ethylene terephthalate) film. On each support was coated a charge transport layer (CTL) on which was coated a charge generation layer (CGL), which in each case was the surface layer of the film. Compositions of the different layers of the four films were as follows (parts are by weight)

Film A (Control)

CGL: 0.65 mg/cm$^2$ dry coverage
- Binder: 67 parts polyester of 4,4'-(2-norbornylidene)-bisdiphenol with 40/60 molar ratio of terephthalic-/azelaic acids
- Photoconductors:
  - 12 parts 1,1-bis(di-4-tolylaminophenyl)cyclohexane
  - 13 parts tri-4-tolylamine
  - 4 parts 4,4'-bis(diethylamino)tetraphenylmethane
- Sensitizer:
  - 3 parts tetrafluoro(oxotitanium)phthalocyanine CTL: 1.29 mg/cm$^2$ dry coverage
- Binders:
  - 57.5 parts bisphenol-A polycarbonate (Lexan 145 polycarbonate from General Electric Company)
  - 2.5 parts polyester of ethylene terephthalate and neopentyl terephthalate (55/45)
- Charge Transport Compounds:
  - 20 parts 1,1-bis-(di-4-tolylaminophenyl)cyclohexane
  - 20 parts tri-4-tolylamine

Film B

Same as Film A, except that 10 parts of the CGL (the surface layer) binder is replaced by the crystalline side chain polyester of Synthesis Example 1.

Film C

Same as Film A, except that 20 parts of the CGL (the surface layer) binder is replaced by the polyester of Synthesis Example 1.

Film D

Same as Film A, except that the CGL (the surface layer) is replaced with a layer composed of:

Binder: 57 parts of the block copolymer of Synthesis Example 2.

Photoconductors:
- 19 parts 1,1-bis(di-4-tolylaminophenyl)-cyclohexane
- 19 parts tri-4-tolylamine
- 2 parts 4,4-bis(diethylamino)tetraphenylmethane
- 3 parts tetrafluoro(oxotitanium)phthalocyanine Sensitometric Tests:

Films A, B, C, and D were tested for photosensitivity by exposure to radiation at 830 nm wavelength and for regeneration capability by charging films to +500 volts. The photodecay speed results are given in the following table:

| Films | Photodecay Speed +500 V. to +250 V. (erg/cm$^2$) |
|---|---|
| A (Control) | 4.3 |
| B | 5.6 |
| C | 6.8 |
| D | 7.1 |

These results show that with regard to electrophotographic speed the films of the present invention (B, C, and D) were equivalent to the control film which contained no crystalline side chain polyester or block copolymer in the surface layer. Likewise, in regeneration tests the films of the invention were equivalent to the control. Thus, the electrophotographic elements of the invention while providing other advantages discussed herein, do not sacrifice the desirable qualities of speed and regenerability.

Image Transfer Tests:

These four photoconductive elements were tested for toner transfer efficiency from the photoconductive surface layer to a paper receiver (6 pt. Kromekote TM) in an electrophotographic copying apparatus equipped with a magnetic brush development station and an electrostatic roller transfer device. The elements were electrostatically charged, exposed to a test pattern and then developed with a 7.7 μm median(V) dry toner powder comprising a styrene-acrylic thermoplastic resin and a carbon black pigment. Table I below summarizes the transfer efficiency ($T_E$) which is defined as follows: $T_E=T_R/(T_R+T_F)$, in which $T_R$ is the transmission density of the toner image on the receiver sheet; $T_F$ is the transmission density of the residual toner image on the photoconductive film surface layer. Both $T_R$ and $T_F$ were corrected by subtracting the background density of the receiving sheet and the photoconductive film.

| Films | Toner Transfer Efficiency, $T_E$ | Transfer Image Defects |
|---|---|---|
| A | 0.63 | Mottle |
| B | 0.95 | None |
| C | 0.93 | None |
| D | 0.94 | None |

As the above table shows, smooth uniform transfer of image with significantly higher toner transfer efficiency is achieved by incorporating in the surface layer of the photoconductive element a block copolymer containing crystalline side chains. The minimum useful concentration depends on variations in surface layer thickness and in the image transfer apparatus.

Another film sample similar to Film C was also tested for low surface adhesion in an electrophotographic apparatus under continuous copying mode. After about 55 cycles, no degrading in film sensitometry or image transfer were observed.

The next example describes the preparation and testing of another photoconductive film of the invention and of a control.

EXAMPLE 5

Two multilayer photoconductive films, designated as films E and F, were also prepared. For each the support or base was a nickelized poly(ethylene phthalate) film. On each support was coated a charge generation layer (CGL) on which was coated a charge transport layer (CTL I). For Film F, a second charge transport layer (CTL II) was coated on top of CTL I. Compositions of the different layers for the two films were as follows (parts are by weight):

Film E (control)

CTL I: 1.51 mg/cm$^2$ dry coverage

Binder: 60 parts polyester of 4,4'-(2-norbornylidene)-diphenol with 40/60 molar ratio of terephthalic-/azelaic acids.

Photoconductors:

34.8 parts 1,1-bis(di-4-tolylaminophenyl)cyclohexane 5.2 parts tri-4-tolylamine 0.25 parts 4,4'-bis(diethylamino)tetraphenylmethane CGL: 280 nm thick layer of 2,9-bis-(2-phenylethyl)anthra(2,9,9-def:6,5,10-d'e'f')-dilsoquinoline-1,3,8,10(2H,9H)-tetrone

Film F

Same as Film E except that a second charge transport layer (CTL II) was coated as the surface layer over CTL I.

CTL II: 0.39 mg/cm$^2$ dry coverage

Binder: 35 parts polyester of 4,4'-(2-norbornylidene)-diphenol with 40/60 molar ratio of terephthalic-/azelaic acids.

Binder Additive: 30 parts crystalline side chain polyester of Synthesis Example 3.

Photoconductors:

17.5 parts 1,1-bis(di-4-tolylaminophenyl)cyclohexane 17.25 parts tri-4-tolylamine 0.25 parts 4,4'-bis(diethylamino)tetraphenylmethane

Sensitometric Tests

Films E and F were tested for photosensitivity by exposure to radiation at 630 nm wavelength and for regeneration capability by charging film to −500 V. The photodecay speed results are given in the following table:

| Films | Photodecay Speed −500 V. to −250 V. (erg/cm$^2$) |
|---|---|
| E | 1.7 |
| F | 1.9 |

Again, these results show that with regard to electrophotographic speed, Film F of the present invention was equivalent to the control Film E. In regeneration tests, Films E and F were also found to perform equally well in electrophotographic cycles. Thus, the electrophotographic elements of the invention while providing additional new advantages, as described above, do not sacrifice the desirable qualities of photosensitivity and regenerability.

Although the examples have described specific photoconductive layer compositions, it should be understood that the photoconductive elements of the invention can employ a wide range of photoconductors and other components. The heterogeneous or aggregate photoconductors of the types discloed in the patent to Light, U.S. Pat. No. 3,615,414, the patent to Gramza et al., U.S. Pat. No. 3,732,180; and the patent to Fox et al, U.S. Pat. No. 3,706,554 are useful for the charge generating layer. Other photoconductors are also suitable, including the organic photoconductors of Rossi, U.S. Pat. No. 3,767,393; Fox, U.S. Pat. No. 3,820,989; and Rule, U.S. Pat. No. 4,127,412; the various photoconductive materials described in Research Disclosure, No. 10938, published May 1973, pages 62 and 63; and especially the phthalocyanine photoconductive pigments of Borsenberger et al, U.S. Pat. No. 4,471,039.

Binders in the charge generation and charge transport layers of the imaging elements of the invention, including the block copolymers employed in the surface layer, are film forming polymers having a fairly high dielectric strength and good electrical insulating properties. Examples of suitable binder resins for layers other than the surface layer include butadiene copolymers; polyvinyl toluene-styrene copolymers; styrene-alkyd resins; silicone-alkyd resins; soya-alkyd resins; vinylidene chloride-vinyl chloride copolymers; poly(-vinylidene chloride); vinylidene chloride-acrylonitrile copolymers; vinyl acetatevinyl chloride copolymers; poly(vinyl acetals) such as poly(vinyl butyral); nitrated polystyrene; polymethylstyrene; isobutylene polymers; polyesters such as poly[ethylene-coalkylenebis-(alkylene-oxyaryl)phenylenedicarboxylate]; phenol formaldehyde resins; ketone resins; polyamides; polycarbonates; polythiocarbonates; poly[ethylene-co-isopropylidene-2,2-bis(ethyleneoxyphenylene)terephthalate]; copolymers of vinyl haloacrylates and vinyl acetate such as poly(vinyl-m-bromobenzoate-co-vinyl acetate); chlorinated poly(olefins) such as chlorinated poly(ethylene); etc.

Polymers containing aromatic or heterocyclic groups are most effective as binders because they provide little or no interference with the transport of charge carriers through the layer. Polymers containing heterocyclic or aromatic groups which are especially useful in p-type charge transport layers include styrene-containing polymers, bisphenol-A polycarbonates, polymers, phenol formaldehyde resins, polyesters such as poly[ethylene-co-isopropylidene-2,2-bis-(ethyleneoxyphenylene)]-terephthalate and copolymers of vinyl haloacrylates and vinyl acetate.

Especially useful binders for either the charge generation or charge transport layers are polyester resins and polycarbonate resins such as disclosed in the patents to Merrill U.S. Pat. Nos. 3,703,372; 3,703,371 and 3,615,406, the patent to Berwick et al U.S. Pat. No. 4,284,699 and the patents to Gramza et al, U.S. Pat. No. 3,684,502 and Rule et al, U.S. Pat. No. 4,127,412. Such polymers can be used in the surface layer in admixture with the block copolymers and copolycarbonates which are employed in the imaging elements of the invention.

The charge generation and charge transport layers can also contain other addenda such as leveling agents, surfactants and plasticizers to enhance various physical properties. In addition, addenda such as contrast control agents to modify the electrophotographic response of the element can be incorporated in the charge transport layers.

The charge generation and the charge transport layers can be formed by solvent coating, the components of the layer being dissolved or dispersed in a suitable liquid. Useful liquids include aromatic hydrocarbons such as benzene, toluene, xylene and mesitylene; ketones such as acetone and butanone; halogenated hydrocarbons such as methylene chloride, chloroform and ethylene chloride; ethers including cyclic ethers such as tetrahydrofuran; ethyl ether; and mixtures of the above. An especially useful quality of the block copolymers having crystalline side chains is that they are soluble or easily dispersible in these common coating solvents.

Vacuum deposition is also a suitable method for depositing certain layers. The compositions are coated on the conductive support to provide the desired dry layer thicknesses. The benefits of the invention are not limited to layers of any particular thicknesses and they can vary considerably, e.g., as disclosed in the cited prior art references. In general, the charge transport layers are thicker than the charge generation layers, e.g., from 5 to 200 times as thick or from about 0.1 to 15 μm dry thickness, particularly 0.5 to 2 μm. Useful results can also be obtained when the charge transport layers are thinner than the charge generation layer.

The improved image transfer properties are obtained in accordance with the invention with a wide range of dry toners and development techniques. The toners can be applied by any dry development technique including magnetic brush development or other development method using single component developers or two component developers with carrier particles. Useful toners include powdered pigmented resins made from various thermoplastic and thermoset remains such as polyacrylates, polystyrene, poly(styrene-coacrylate), polyesters, phenolics and the like, and can contain colorants such as carbon black or organic pigments or dyes. Other additives such as charge-control agents and surfactants can also be included in the toner formulation.

Examples of suitable toner compositions include the polyester toner compositions of U.S. Pat. No. 4,140,644; the polyester toners having a p-hydroxybenzoic acid recurring unit of U.S. Pat. No. 4,446,302; the toners containing branched polyesters of U.S. Pat. No. 4,217,440 and the crosslinked styrene-acrylic toners and polyester toners of U.S. Pat. No. Re. 31,072; the phosphonium charge agents of U.S. Pat. Nos. 4,496,643 and the ammonium charge agents of U.S. Pat. Nos. 4,394,430; 4,323,634 and 3,893,935. They can be used with plural component developers with various carriers such as the magnetic carrier particles of U.S. Pat. No. 4,546,060 and the passivated carrier particles of U.S. Pat. No. 4,310,611.

While the avoidance of the hollow-character defect has been discussed, it should be understood that electrophotographic elements of the invention, because of their excellent toner-transfer quality, provide other advantages. These include, for example, avoidance or reduction of mottle and of the so-called "halo" defect in multicolor images. Other advantages include the lessening of toner scumming on the surface of the photoconductive element, with consequent easier cleaning of the element between development cycles, which in turn results in longer film life.

The invention has been described with reference to certain preferred embodiments, but it will be understood that variations and modifications can be made within the spirit and scope of the invention.

We claim:

1. An electrophotographic imaging element comprising a conductive support and a surface layer that comprises a charge generating material or a charge transport material, said surface layer having an electrically insulating binder resin matrix which comprises a polymer containing polyester repeating units which have crystalline side chains.

2. An element according to claim 1 wherein said polymer is a crystalline side chain polyester or a block copolyester or block copolycarbonate having a crystalline side chain polyester block.

3. An element according to claim 1 wherein the binder resin matrix comprises a polymer containing polyester repeating units of the formula, $$\left[\overset{O}{\overset{\|}{C}}-R-\overset{O}{\overset{\|}{C}}-O-(CH_2)_{m'}-\underset{\underset{R^2}{|}}{CH}-(CH_2)_{n'}-O\right]_l$$

wherein

R =

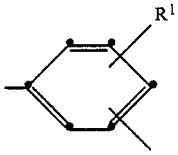

or $$R = -(CH_2)_m-\underset{\underset{R^1}{|}}{CH}-(CH_2)_n-$$

wherein m, n, m′ and n′ are zero or positive integers the sum of m plus n is from 0 to 3, the sum of m′ plus n′ is from 1 to 5, $R^1$ and $R^2$ are crystalline aliphatic hydrocarbon groups or hydrogen, with the proviso that no more than one of such groups is hydrogen, and l is an integer from 10 to 100.

4. An element according to claim 3, wherein said polyester repeating units amount to about 5 to 50 weight percent of the binder resin matrix.

5. An element according to claim 4 wherein said polymer is a polyester.

6. An element according to claim 4 wherein said polymer is a block copolyester or block copolycarbonate of which said polyester repeating units form a block.

7. An element according to claim 6 wherein said polymer is a block copolyester which is a derivative of one or more dicarboxylic acids and one or more diols, at least one of the acids being an aromatic dicarboxylic acid.

8. An element according to claim 6 wherein the binder resin matrix consists essentially of said block copolymer.

9. An element according to claim 6 wherein the binder resin matrix comprises a blend of polyester or polycarbonate binder resin and said block copolymer, the amount of said block copolymer being sufficient to provide an amount in the binder resin matrix of said block which contains crystalline hydrocarbon groups comprising from about 5 to 50 weight percent of the binder resin matrix.

10. An element according to claim 1 wherein the element is a multilayer element comprising a charge generation layer and a charge transport layer.

11. An element according to claim 2 wherein the surface layer contains a photoconductive phthalocyanine pigment.

12. An element according to claim 10 comprising in sequence a conductive support, a charge generation layer, a first charge transport layer and, as the surface layer, a second charge transport layer.

13. An element according to claim 5 wherein the binder resin matrix is a blend of poly(ethylene-2-n-octadecylsuccinate) and a polyester or polycarbonate binder resin.

14. An element according to claim 7 wherein said polymer is poly(4,4'-(2-norbornylidene) bisphenol-terephthalate-co-azelate)-block-poly (ethylene-2-n-octadecylsuccinate).

* * * * *